US005746170A

United States Patent [19]

Moriya

[11] Patent Number: 5,746,170

[45] Date of Patent: May 5, 1998

[54] ENGINE OIL BLOCK FOR USE IN ROUTING OIL TO AN OIL COOLER

[75] Inventor: Yukio Moriya, Nerima-ku, Japan

[73] Assignee: Ginko Bussan Co., Ltd., Tokyo, Japan

[21] Appl. No.: 751,422

[22] Filed: Nov. 18, 1996

[30] Foreign Application Priority Data

Nov. 16, 1995 [JP] Japan ..... 7-322298
Nov. 21, 1995 [JP] Japan ..... 7-326549

[51] Int. Cl.[6] ..... F01M 5/00

[52] U.S. Cl. ..... 123/196 AB; 184/104.3

[58] Field of Search ..... 123/196 AB; 184/104.2, 184/104.3

[56] References Cited

U.S. PATENT DOCUMENTS

| | | | |
|---|---|---|---|
| 4,335,688 | 6/1982 | Diederich, Jr. | 184/104.3 |
| 4,337,737 | 7/1982 | Pechner | 123/196 AB |
| 4,671,229 | 6/1987 | Barnes | 123/196 AB |
| 4,736,819 | 4/1988 | Muller | 123/196 AB |
| 4,862,955 | 9/1989 | Itakura | 123/196 AB |
| 5,291,969 | 3/1994 | Diederich, Jr. | 184/104.3 |

FOREIGN PATENT DOCUMENTS

| | | | |
|---|---|---|---|
| 265 662 A1 | 3/1989 | Germany | 123/196 AB |
| 61-39489 | 9/1986 | Japan . | |
| 2 278 400 | 11/1994 | United Kingdom | 123/169 AB |
| 83/02822 | 8/1983 | WIPO | 123/196 AB |

*Primary Examiner*—Erick R. Solis
*Attorney, Agent, or Firm*—Wenderoth, Lind & Ponack

[57] ABSTRACT

An engine oil block has an oil block body and a thermostat disposed in the oil block body. The oil block body is provided with an oil inlet passage connected on one side to the oil outlet of an engine block and on the other side to the oil inlet of an oil cooler. The oil block also has an oil outlet passage connected on one side to the oil inlet of the engine block and on the other side to the oil outlet of the oil cooler. A communication passage connects the oil inlet passage to the oil outlet passage. The thermostat is disposed in the communication passage for moving a valve member via a shape memory alloy member depending on the temperature of engine oil.

9 Claims, 9 Drawing Sheets

ENGINE OIL BLOCK FOR USE IN ROUTING OIL TO AN OIL COOLER

BACKGROUND OF THE INVENTION

1. Technical Field

The invention relates to an oil block which may be provided between an engine block and an oil cooler. The oil block routes oil from the engine to the oil cooler when the temperature of the engine oil is high.

2. Prior Art

Conventional oil blocks have an oil block body with a wax-type thermostat. When a wax-type thermostat is used, it is necessary to install a liquid tank which has the same capacity as the engine oil tank. One of the disadvantages of such conventional oil blocks is that the thermostat, as well as the oil-block body in which the thermostat is provided, must be large. Further problems arise in that it is difficult to attach the oversized oil block body to the engine. This problem comes about because such oversized oil blocks have many peripheral components. Furthermore, the production cost is increased.

SUMMARY OF THE INVENTION

The object of the present invention is to provide an oil block of simple construction which routes oil to an oil cooler according to the temperature of the oil. It is also an object of the present invention to make the entire system compact and easily attachable to the engine while keeping the production cost low.

The oil block of the present invention has a thermostat mounted in an oil block body. The oil block body is provided with an oil inlet channel connectable at one side to an oil outlet of an engine block and at another side to an oil inlet of an oil cooler. The oil block body is also provided with an oil outlet channel connectable at one side to an oil inlet of the engine block and at another side to an oil outlet of the oil cooler. A communication passage connects the oil inlet channel to the oil outlet channel. The thermostat includes a shape memory alloy member which is expandable depending on the temperature of the engine oil. A valve member is movable within the communication passage to an open position where a passage port is opened between the oil inlet channel and the communication passage. When the temperature of the engine oil is low, the oil from the engine block is returned to the engine block without being routed to the oil cooler. Alternatively, when the temperature of the engine oil is high, the valve member is movable to a closed position where the passage port is closed and the oil from the engine block is routed to the oil cooler.

DETAILED DESCRIPTION OF THE PREFERRED EMBODIMENTS

Figure 1:
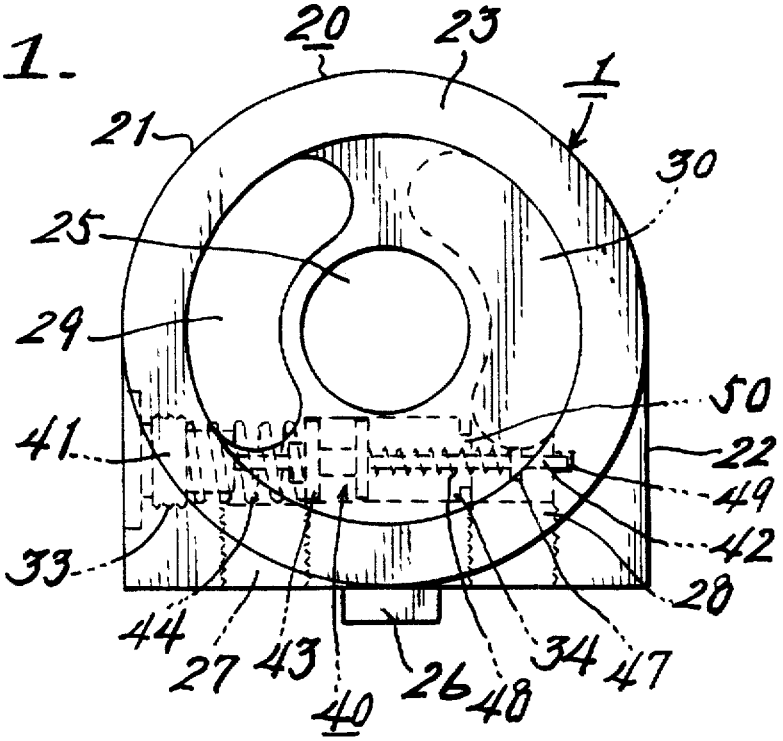
FIG. 1 is a plan view of the first embodiment of the oil block according to the present invention.

An oil block 1 of the first embodiment shown in FIG. 1 to FIG. 7 can be fitted to an engine block 5 at one side surface thereof and to an oil filter 6 at another side surface thereof. The oil block can be disposed between the engine block 5 and an oil cooler 2 for routing the engine oil through oil hoses 3 and 4 to the oil cooler 2. With this set-up, the engine oil of an automobile can be cooled.

The oil block 1 includes an oil block body 20 and a thermostat 40. The thermostat is provided in the oil block body. The oil block body 20 is preferably made of light metals which resist corrosion. The oil block body consists of an arc block section 21 and a rectangular block section 22 which is integral with the arc block section 21. Side surface 23 of the arc block section 21 is formed so as to allow a sealed connection with the oil filter 6, while side surface 24 is formed so as to allow a sealed connection with the engine block 5.

Figure 2:
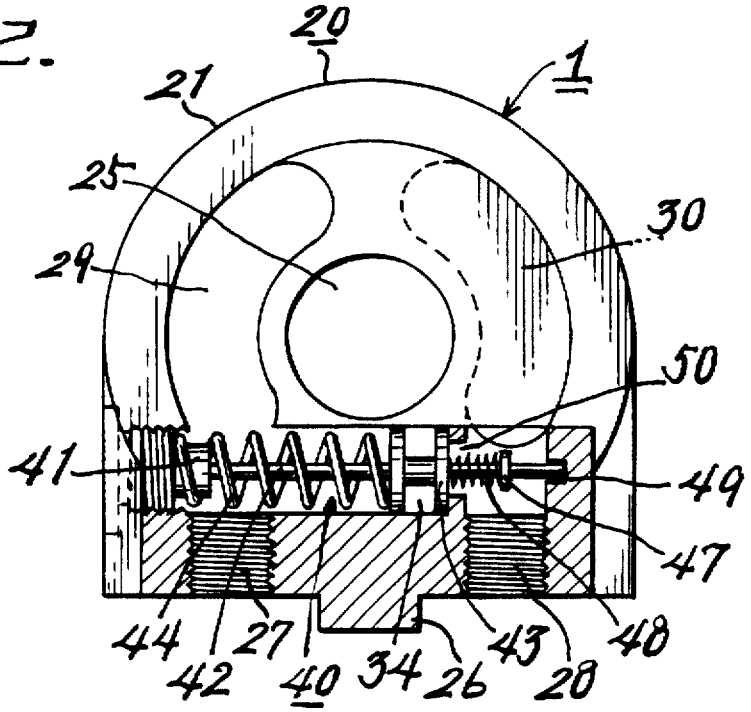
FIG. 2 is a partial sectional plan view of the thermostat portion of FIG. 1.
Figure 3:
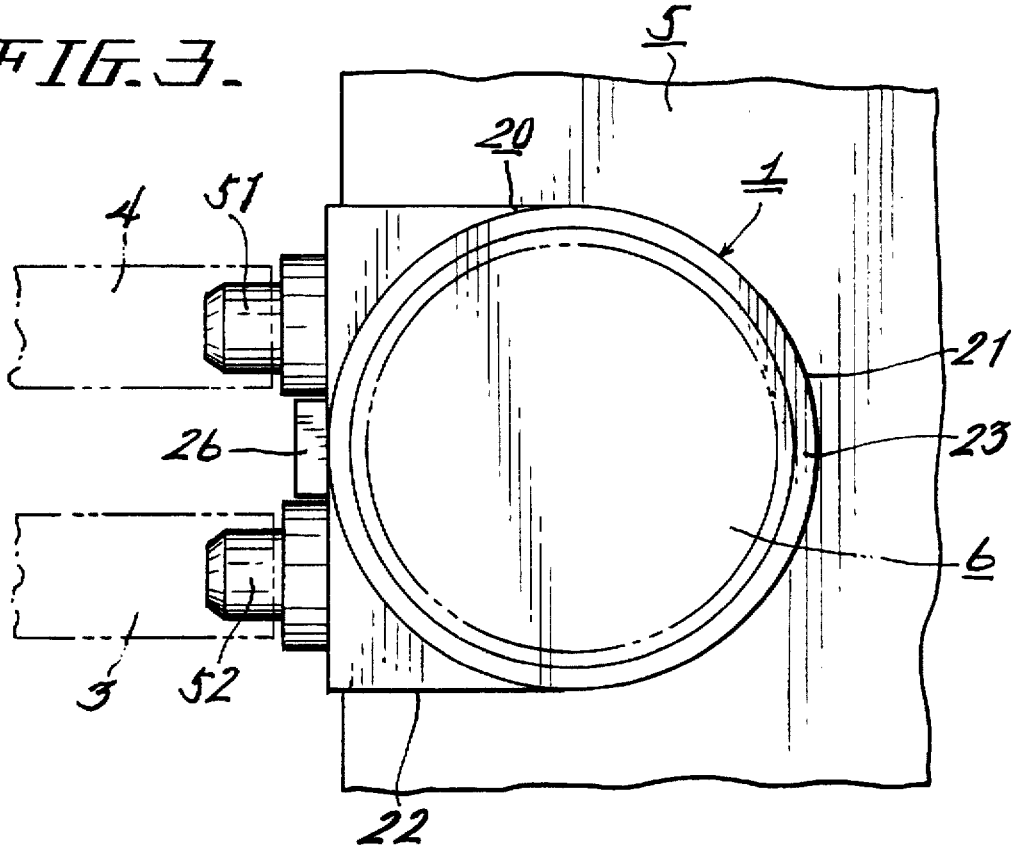
FIG. 3 is a plan view showing the oil bock according to the present invention as connected to an engine block, oil filter, and oil cooler.
Figure 4:
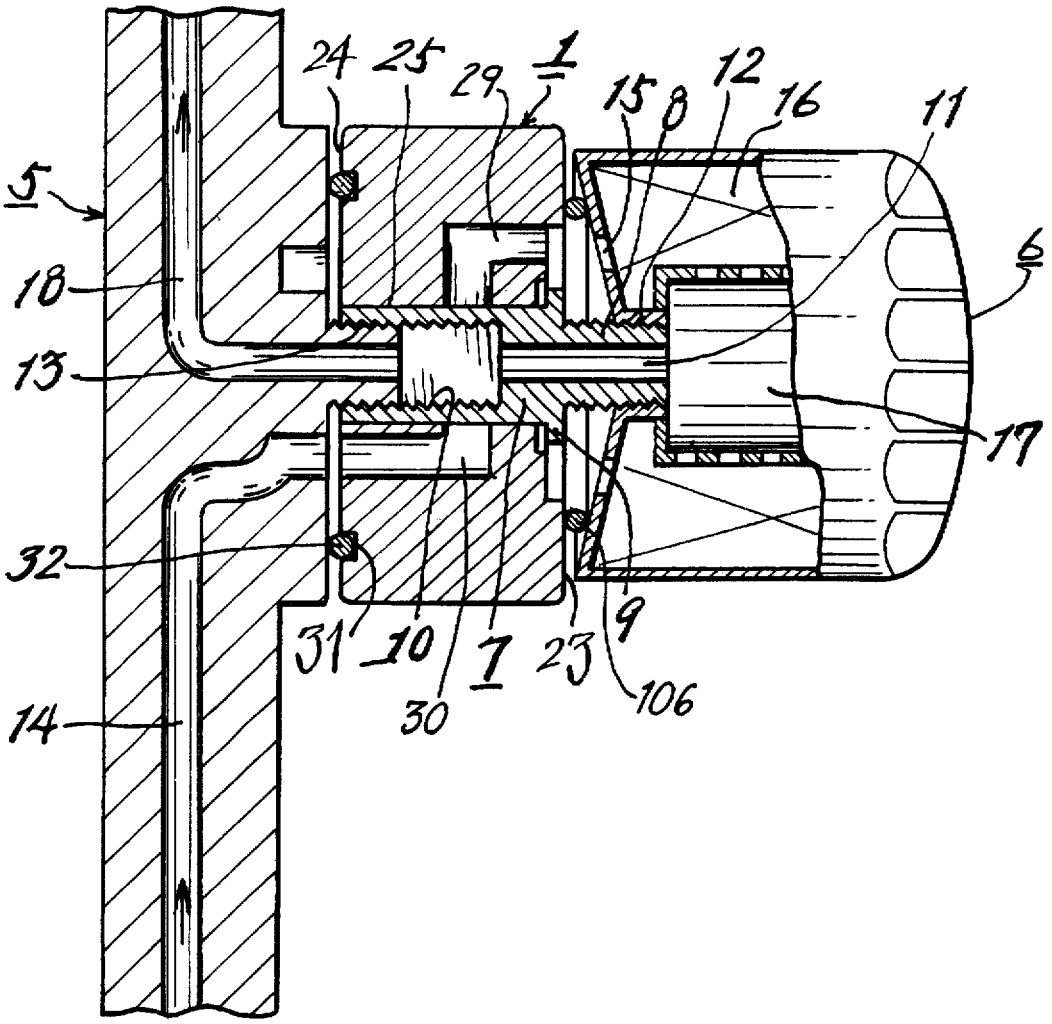
FIG. 4 is a sectional view showing the oil block according to the present invention as connected to an engine block, oil filter and oil cooler.

As shown in FIG. 1 and FIG. 4, the arc block section 21 is provided at the center with a fitting hole 25 into which a fitting member 7 is inserted in order to fit the oil block body 20 to the engine block 5. The fitting member 7 comprises a cylindrical body having an external thread portion 8, a nut portion 9 and an internal thread portion 10. It also includes an oil circulation passage 11 formed in the direction of the center longitudinal axis. The rectangular block section 22 is provided as shown in FIG. 1 to FIG. 3, with an oil inlet passage 27 and an oil outlet passage 28 on both sides of a positioning block section 26. These passages are formed as part of an oil outlet channel 30 and an oil inlet channel 29 respectively. The oil outlet channel 29 has an opening in side surface 23 and forms a path which extends from the outer end of the oil inlet passage 27 to the oil filter 6. An oil inlet channel 30 has an opening in side surface 24 and forms a path which extends from the outer end of the oil outlet passage 28 to the engine block 5. As shown in FIG. 4, a concave slot 31 is also formed in side surface 24 for mounting a ring packing 32. In addition, the rectangular block section 22 is provided with a communication passage 34 which connects at a right angle the passage/channel combination 27, 29 to the passage/channel combination 28, 30. One end wall of the communication passage 34 has formed therein a threaded hole 33 into which a thermostat 40 is screwed.

As can be seen in FIG. 2, the thermostat 40 has a threaded plug member 41 screwed into the threaded hole 33 in an end wall of the communication passage 34. The thermostat also has a shaft 42 secured to the center of the threaded plug member 41. A valve member 43 is loosely engaged on the shaft 42 so as to be able to slide along the shaft. A shape memory alloy member 44 is wound spirally along the shaft 42 and is interposed between the threaded plug member 41 and one end of the value member 43. A bias-spring 48 is interposed between the other end of the valve member 43 and a spring seat 47. As shown in greater detail in FIG. 13, the spring seat 47 is fixed to the shaft 42 by a retaining ring retained in a peripheral slot near the end of the shaft 42. Turning again to FIG. 2, the thermostat 40 is laterally mounted in the oil block body 20. The mounting is accomplished by screwing the threaded plug member 41 into the threaded hole 33 and inserting the end of the shaft 42 into an insert hole 49 which is formed an end wall of the communication passage 34. The thermostat is arranged so that when the engine oil is cooled and its temperature is low, the shape memory alloy member 44 is contracted, and the valve member 43 is moved by the action of the bias-spring 48 into an open position as shown in FIG. 1. This open position results in an opening of a passage port 50 which is formed in the communication passage 34 between the oil inlet channel 30 and the oil outlet channel 29. In this position, the oil from the engine block 5 will return to the oil block 5 via the oil filter 6 without flowing into the oil cooler 2. Alternatively, when the oil temperature is high, the shape memory alloy member 44 is expanded causing the valve member 43 to be moved by the shape memory alloy 44 into a closed position as shown in FIG. 2. This closed position results in the valve member being moved against the elastic force of the bias-spring 48 to close the passage port 50, thereby allowing the oil to be introduced into the oil cooler 2 via oil outlet passage 28.

As shown in FIG. 3 and FIG. 4, the oil block 1 is mounted on the engine block 5 and the oil filter 6 in such manner that the fitting member 7 is inserted into the fitting hole 25 of the oil block body 20. An inner threaded hole 12 of the oil filter 6 is screwed onto the external thread portion 8 of the fitting member 7. The junction between the oil filter and side surface 23 is sealed by ring packing 106. In this way the oil filter 6 is fixed to the block 1. The internal thread portion 10 of the fitting member 7 is screwed to an external thread portion 13 of the engine block 5. The junction between the engine block and side surface 24 is sealed by ring packing 32, thus fixing the oil block 1 to the engine block 5. The oil inlet passage 27 is connected to an outlet of the oil cooler 2 by fastening hose 4 to a nipple 51, at the end of oil inlet passage 27. The oil outlet passage 28 is connected to an inlet of the oil cooler 2 by fastening hose 3 to a nipple 52 at the end of oil outlet passage 28. When the engine is started and the engine oil is still cool, the shape memory alloy member 44 of the thermostat 40 is contracted and the valve member 43 is moved by the action of the bias-spring to keep the passage port 50 open. The oil from the engine block 5 is therefore not introduced into the oil cooler 2 and will flow into the engine block 5 via the following channel: the outlet passage 14 of engine block 5; oil inlet channel 30; passage port 50; communication passage 34; oil outlet channel 29; inlet hole 15 of oil filter 6; oil filtering element 16; introducing passage 17; oil circulation passage 11; inlet passage 18 of engine block 5. As the temperature of the engine oil gets warmer, the shape memory alloy member 44 of the thermostat 40 expands moving the valve member 43 against the elastic force of bias spring 48. The valve member 43 thus closes the passage port 50 and the oil from the engine block 5 flows through the following channel: the outlet passage 14 of engine block 5; oil inlet channel 30; oil outlet passage 28; nipple 52; hose 3; inlet of oil cooler 2; oil cooler 2; outlet of oil cooler; hose 4; nipple 51; oil inlet passage 27; oil outlet channel 29; inlet hole 15 of oil filter 6; oil filtering element 16; introducing passage 17; oil circulation passage 11; oil inlet passage 18 of engine block 5.

Figure 5:
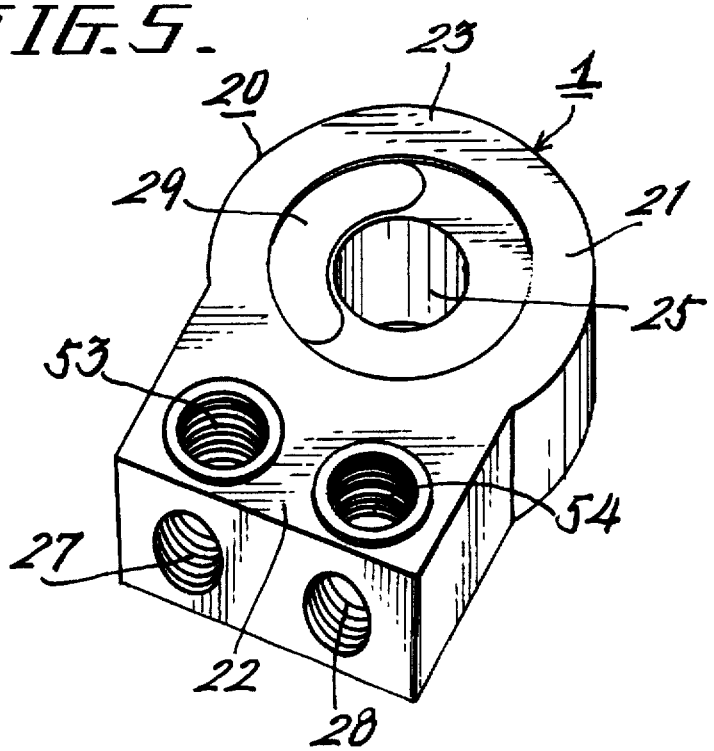
FIG. 5 is a perspective view of a modification of the oil block shown in FIG. 1.
Figure 6:
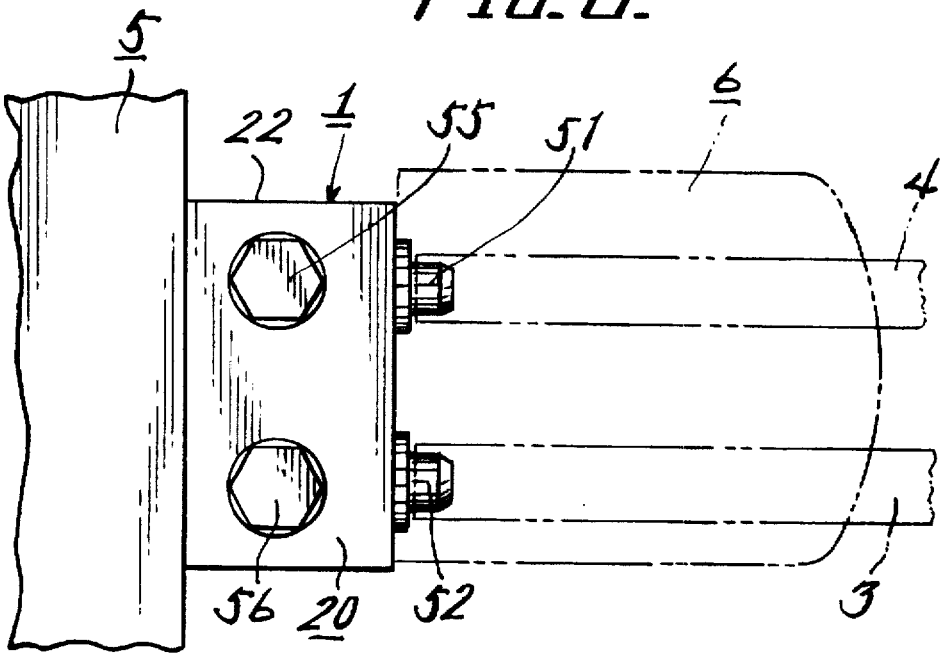
FIG. 6 is an explanatory view showing the oil block of FIG. 5 as connected to an engine block, oil filter, and oil cooler.
Figure 7:
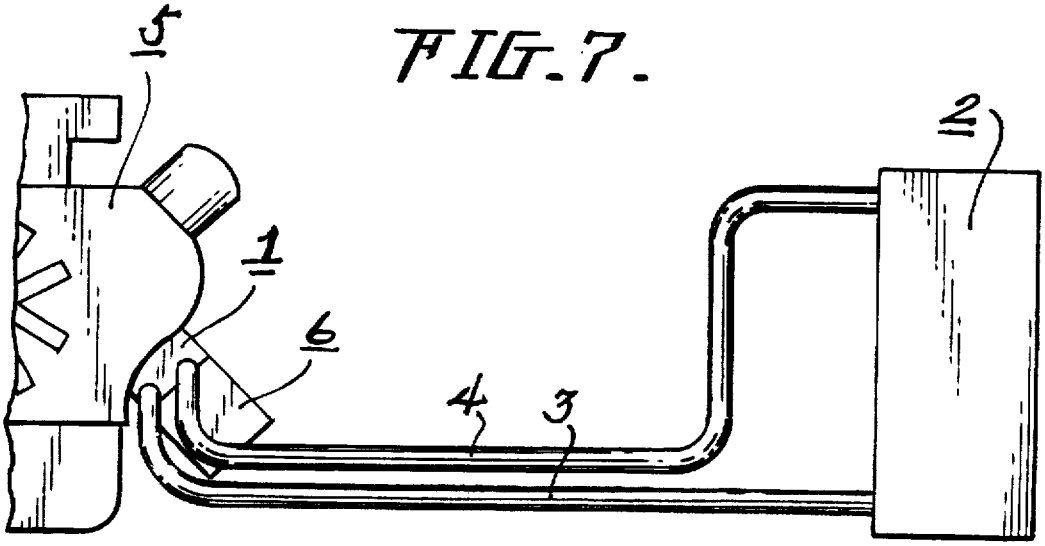
FIG. 7 is an explanatory view showing the relationship between the oil block, engine block and oil cooler of the first embodiment of the present invention.
Figure 8:
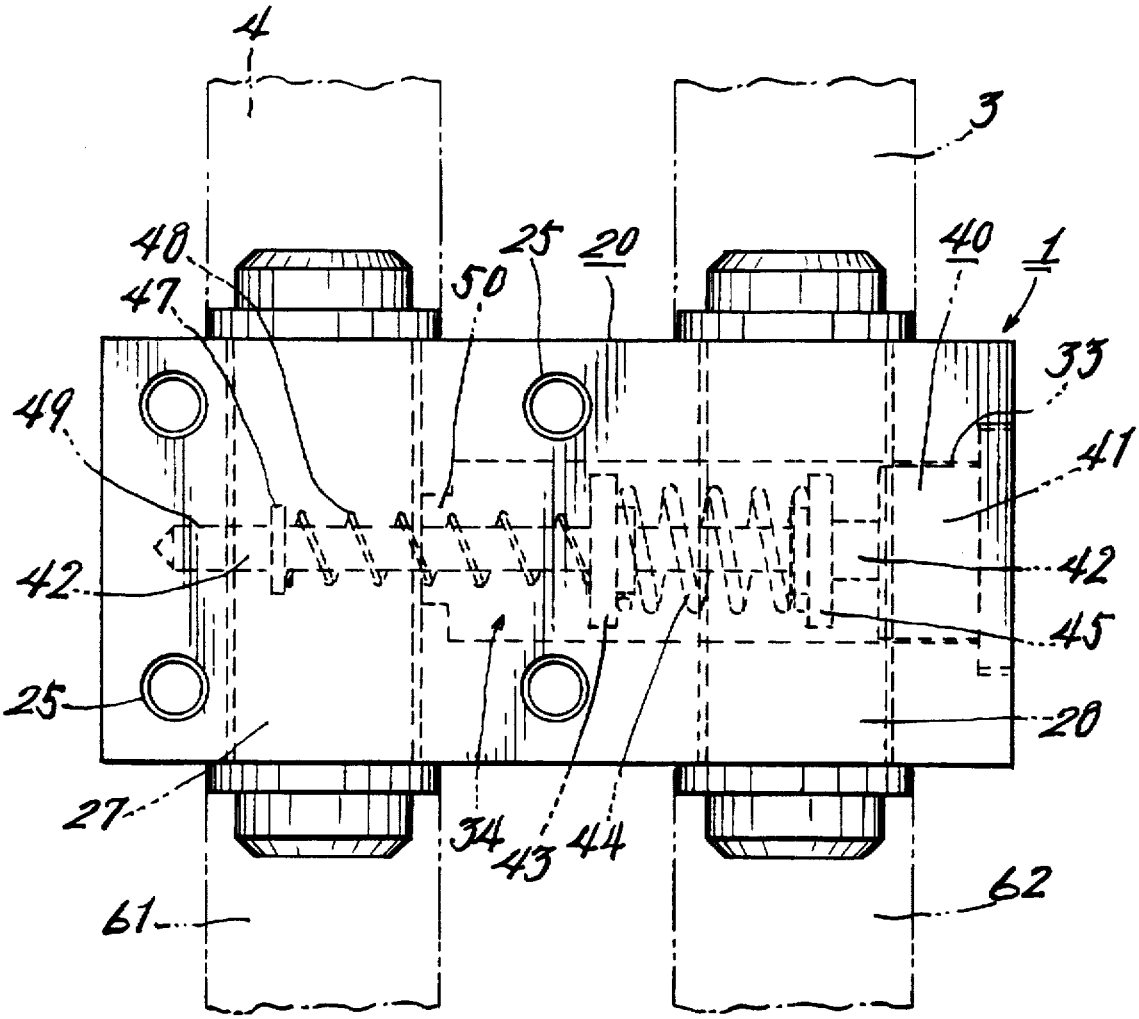
FIG. 8 is a plan view of a second embodiment of the oil block according to the present invention.

FIG. 5 and FIG. 6 show a modification of the oil block 1 according to the present invention. As illustrated in the modification, the rectangular block section 22 is provided at an upper surface with a threaded hole 53 communicating at a right angle to the oil inlet passage 27 and with a threaded hole 54 communicating at a right angle to the oil outlet passage 28. As shown in FIG. 6, the oil inlet passage 27 can be blocked by screwing blocking member 55 into oil inlet passage 27. Correspondingly, the oil outlet passage 28 can be blocked by screwing blocking member 56 into oil outlet passage 28. The hose 4 is fastened to nipple 51 which is screwed into the threaded hole 53. The other end of hose 4 is connected to the outlet of the oil cooler 2. Likewise, the hose 3 is fastened to nipple 52 which is screwed into the threaded hole 54. The other end of hose 3 is connected to the inlet side of the oil cooler 2. In this manner the oil can be routed vertically from the engine block. The modified oil block can also be configured to route the oil to and from the oil cooler via the oil inlet and outlet passages 27 and 28 by blocking the threaded holes 53 and 54 with blocking members 55 and 56. In either configuration, instead of blocking members 55 and 56, a sensor for an oil thermometer and an oil pressure gauge may be fit into whichever of the oil inlet and outlet passages 27 and 28, or the threaded holes 53 and 54 that are not used for routing oil.

Figure 9:
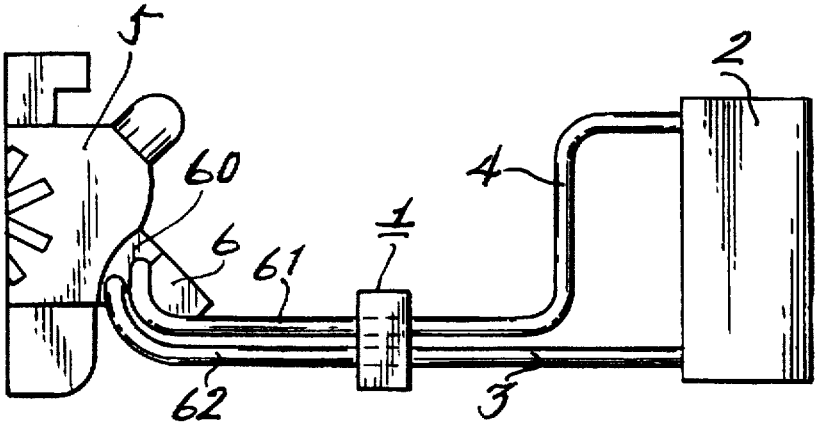
FIG. 9 is an explanatory view showing one example of a relationship between the oil block, engine block and oil cooler of the second embodiment of the present invention.
Figure 10:
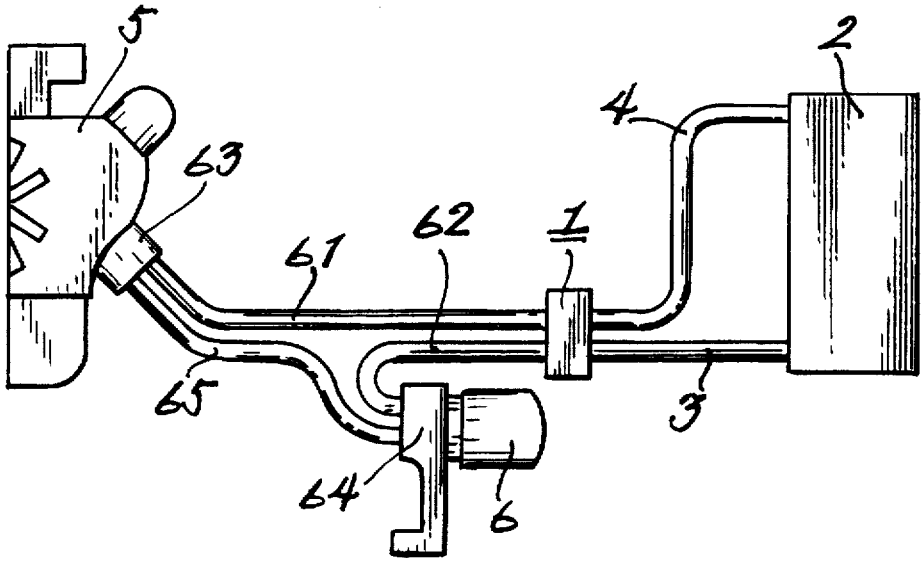
FIG. 10 is an explanatory view showing another example of a relationship between the oil block, engine block and oil cooler of the second embodiment of the present invention.
Figure 11:
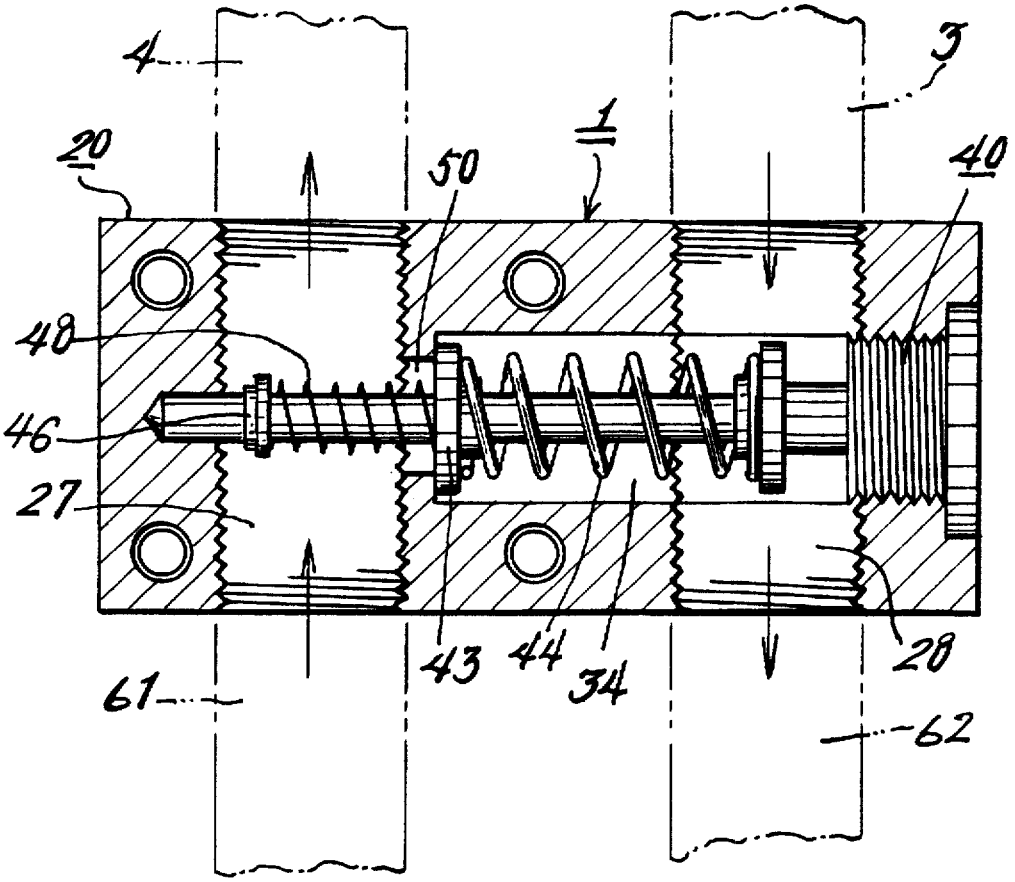
FIG. 11 is a cross-sectional view of FIG. 8 showing the thermostat in a closed position.
Figure 12:
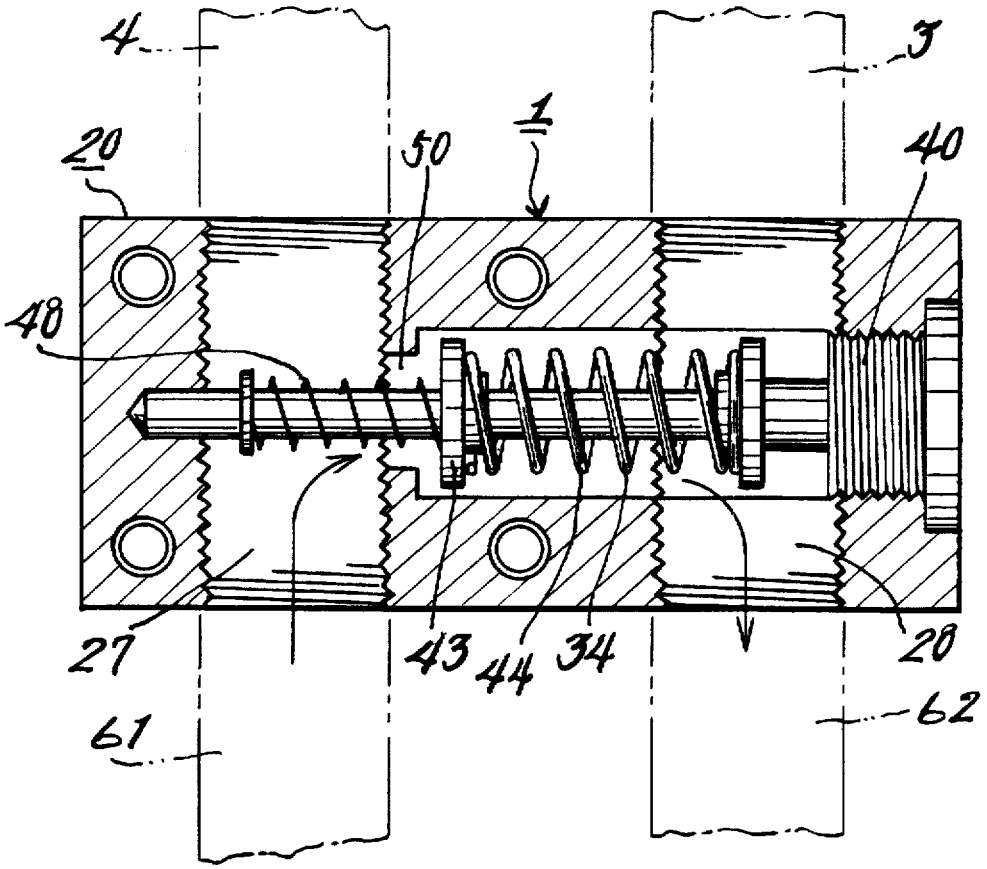
FIG. 12 is a cross-sectional view of FIG. 8 showing the thermostat in an open position.

An oil block 1 of a second embodiment is shown in FIG. 8 to FIG. 13. FIG. 9 shows a sandwich type configuration, including an oil block and a sandwich block 60. In this configuration, a first threaded passage of the oil block 1 is connected through a hose 61 to a first threaded hole (not shown) of the sandwich block 60. The sandwich block is attached on one side to the engine block 5 and on the other side to the oil filter 6. The other end of the first threaded hole of the oil block 1 is connected through the hose 4 to the inlet of the oil cooler 2. The outlet of the oil cooler 2 is connected through the hose 3 to one end of second threaded passage of the oil block 1. The other end of the second threaded passage of the oil block 1 is connected through a hose 62 to the second threaded passage (not shown) of the sandwich block 60. FIG. 10 shows a bypass type configuration. In this configuration one end of the first threaded passage of the oil block 1 is connected through the hose 61 to one end of a bypass adapter 63 fitted to the engine block 5. The other end of the first threaded passage of the oil block 1 is connected through the hose 4 to the inlet of the oil cooler 2. The outlet of the oil cooler 2 is connected through the hose 3 to one end of the second threaded passage of the oil block 1 and the other end of the second threaded passage of the oil block 1 is connected through a hose 62 to one end of the oil filter 6 which is attached to a bypass bracket 64. The other end of the oil filter 6 is connected though a hose 65 to the other end of the bypass adapter 63.

The oil block 1 of the second embodiment may be used in the two configurations mentioned above, and includes the oil block body 20 and the thermostat 40 fitted to the oil block body 20 as in the first embodiment of the present invention.

In the second embodiment, the oil inlet passage 27 and the oil outlet passage 28 are formed in parallel through the oil block body. The communication passage 34 connects, and is formed at right angles to, the oil inlet passage 27 and the oil outlet passage 28. The communication passage 34 includes a coaxial threaded hole 33, a large diameter area in which the shape memory alloy member is placed, and a small diameter area through which the bias spring 48 extends. The passage port 50 is formed between the large diameter area and small diameter area of the communication passage 34. The oil inlet passage 27 has an insert hole 49 formed in its side, into which the end of the shaft of the thermostat 40 is inserted. The oil block body 20 is provided with a plurality of mounting screw holes 25.

The thermostat 40 comprises the threaded plug member 41 screwed into the threaded hole 33 of an end wall of the communication passage 34 and the shaft 42 fixed into the center portion of the threaded plug member 41. A seat member 45 is fixed by the shaft 42 to the threaded plug member 41. The valve member 43 is able to slide along the shaft 42. The shape memory alloy member 44 is wound spirally along the shaft 42 and is interposed between one end side of the valve member 43 and the seat member 45. A bias-spring seat 47 is fixed to the shaft 42 by a retaining ring 46 retained in a peripheral slot near the end of the shaft 42. The thermostat 40 is laterally mounted in the communication passage 34 by screwing the threaded plug member 41 into the threaded hole 33 and inserting the end of the shaft 42 into the insert hole 49.

The shape that the shape-memory alloy member 44 of the first and second embodiments memorizes is that of a spring. The preset strength of the spring of the shape memory alloy member 44 is set higher for use with higher oil temperatures. For example, it may be preset so that the strength of spring is 2.5 kgf/cm2 at a temperature of 75° C.; 3.3 kgf/cm2 at 85° C.; 3.5 kgf/cm2 at 90° C.; 3.9 kgf/cm2 at 150° C.; Okgf/cm2 at or under 30° C. Further, the valve member 43 is movable under the balance of mutual strength between the shape memory alloy member 44 and bias-spring 48 to control the oil flow. The bias-spring 48 determines the sensitivity to temperature of the valve member. A stronger bias spring will provide more resistance to the force of the shape memory alloy member and will thus lower the sensitivity of movement of the valve with respect to changes in temperature of the oil. Likewise, a weaker bias spring will provide less resistance to the force of the shape memory alloy member and will thus increase the sensitivity of the movement of the valve with respect to changes in temperature of the oil. Various conditions such as the strength, wire diameter, number of coils, length etc. of the bias-spring 48 become important.

The operation of the oil block of the second embodiment is now described with reference to FIG. 9 to FIG. 12. When the engine is started, the engine oil is still cool, the oil temperature is low and consequently the shape memory alloy member 44 of the thermostat 40 is contracted and the valve member 43 is moved by the bias-spring 48 such that the passage port 50 is open to fill the hose 4, oil cooler 2, hose 3, hose 62, and oil filter 6 (and hose 65 of the configuration of FIG. 10) under the same pressure. The inside of the core of the oil cooler 2 has stronger resistance than the inside of the hose 62 since the core of the oil cooler 2 is provided with a narrow passage for cooling oil. Since a liquid flows through a path of least resistance, the oil from the hose 61 will take a U-turn at the oil block 1 and come back through the hose 62. Therefore, the flow of the engine oil when the engine oil is cold will be through the channel: engine block 5; sandwich block 60; hose 61; oil inlet passage 27 in the oil block 1; passage port 50; communication passage 34; oil outlet passage 28; hose 62; sandwich block 60; oil filter 6; engine block 5 (FIG. 9). Alternatively, in the bypass configuration, the flow is through the channel: engine block 5; bypass adapter 63; hose 61; oil inlet passage 27 in the oil block; passage port 50; communication passage 34; oil outlet passage 28; hose 62; oil filter 6; hose 65; bypass adapter 63; engine block 5 (FIG. 10). In both configurations, the oil will flow to the engine block 5 without flowing through the oil cooler 2.

As the engine oil is warmed and its temperature becomes higher, the shape memory alloy member 44 of the thermostat 40 is expanded causing the valve member 43 to move against the elastic force of the bias-spring 48 to block off the passage port 50. In this situation the oil from the engine block 5 will flow via the channel: engine block 5; sandwich block 60; hose 61; oil inlet passage 27 in the oil block 1; hose 4; oil cooler 2; hose 3; oil outlet passage 28 of the oil block 1; hose 62; sandwich block 60; oil filter 6; engine block 5 (FIG. 9). In the bypass configuration, the flow is through the channel: engine block 5; bypass adapter 63; hose 61; oil inlet passage 27 of the oil block 1; hose 4; oil cooler 2; hose 3; oil outlet passage 28; hose 62; oil filter 6; hose 65; bypass adapter 63; engine block 5 (FIG. 10). The engine oil will, in either configuration, be cooled through the core of the oil cooler 2. The characteristics of the bias spring and the shape memory alloy member are selected so as to provide predetermined opening and closing temperatures of the value member 43, i.e., temperatures at which the valve opens and closes. When the opening and closing temperatures for the valve member 43 of the thermostat 40 are matched to a suitable temperature of the engine oil, the engine oil will flow to the oil cooler 2 only when necessary. For example, in the winter when the engine is first started the engine oil does not flow through the oil cooler until the engine gets warm. This will induce the oil to get warm quickly. When the oil cooler gets excessively cool and the oil temperature decreases, the thermostat valve will immediately be opened to automatically prevent the oil from being over-cooled. In the summer, since the oil temperature is higher, the thermostat valve is closed sooner so that the oil can flow into the oil cooler preventing the oil from being overheated.

Figure 13:
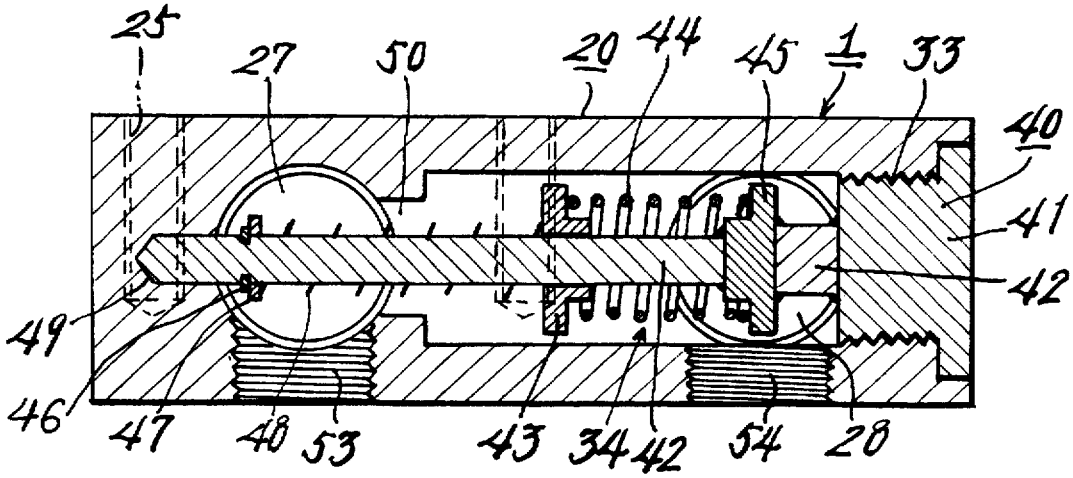
FIG. 13 is a longitudinal sectional view of a modification of the oil block shown in FIG. 8.
Figure 14:
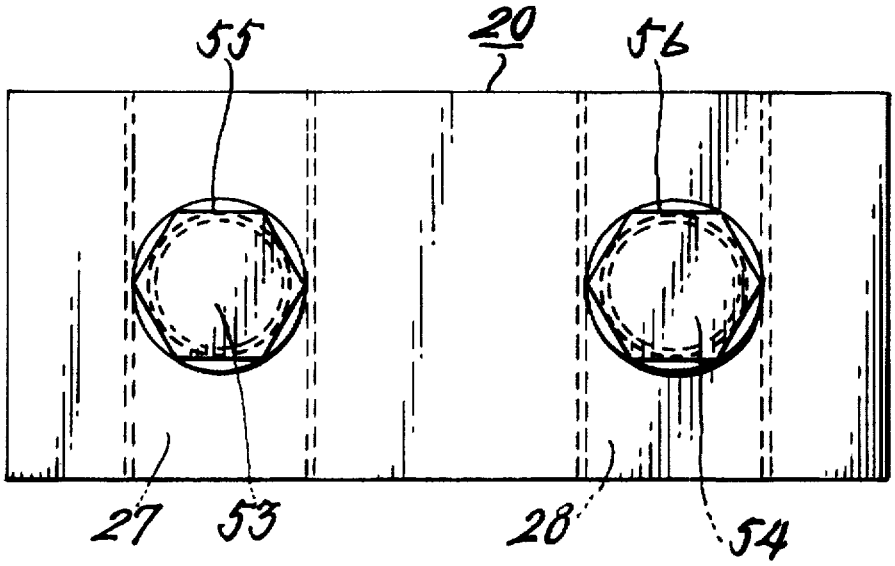
FIG. 14 is a bottom plan view of the modification of FIG. 13.

FIG. 13 and FIG. 14 show a modification for detecting the temperature and pressure of the oil which flows into the oil block of the second embodiment of the present invention. As illustrated in the modification, the oil block body 20 is provided with threaded holes 53 and 54 connected at right angles to the oil inlet passage 27 and oil outlet passage 28 respectively. Into the holes 53 and 54 are fixed a sensor for an oil thermometer and oil pressure gauge via an adapter. The thermometer and pressure gauge are separately arranged to detect the oil temperature and pressure of the oil which are closely related to the operating condition of the engine. These two threaded holes 53, 54 may be blocked off by screwing in the valve members 55, 56 when detection is not required.

According to the present invention, the valve member 43 of the thermostat 40 provided in the oil block body 20 is moved by the shape memory alloy member 44. The present invention allows for the simplification and miniaturization of construction since it does not need a liquid tank as required in the prior art. Therefore, the whole system can be miniaturized, making it easier to fit to an engine. Thus the production costs are reduced while still providing for the detection of the engine oil temperature and pressure.

What is claimed is:

1. An engine oil block for use with an engine block having an oil inlet and an oil outlet, an oil cooler having an oil inlet and an oil outlet, and an oil filter having an oil inlet and an oil outlet, and for use in selectively routing engine oil from the engine block to the oil cooler, said engine oil block comprising:

an oil block body having formed therein, an oil inlet channel connectable at one side thereof to the oil outlet of the engine block and at another side thereof to the oil inlet of the oil cooler, an oil outlet channel connectable at one side thereof to the oil outlet of the oil cooler and at another side thereof to the oil inlet of the oil filter, an oil circulation passage connectable at one side thereof to the oil outlet of the oil filter and at another side thereof to the oil inlet of the engine block, a communication passage connecting said oil inlet channel to said oil outlet channel and comprising a threaded mounting hole in an end wall thereof and an insert hole in another end wall thereof, a passage port located between said oil inlet channel and said communication passage;

a thermostat provided in said communication passage comprising, a threaded plug screwed into said threaded mounting hole, a shaft secured at one end thereof to the center of said threaded plug and inserted into said insert hole at another end thereof, a valve member movable along said shaft for opening and closing said passage port, a shape memory alloy member expandable depending on the temperature of the oil, wound spirally along said shaft and arranged between said valve member and said threaded plug for moving said valve member along said shaft, a bias spring seat retained on said shaft, a bias spring arranged on said shaft between said valve member and said bias spring seat;

wherein said valve member is movable by said shape memory alloy member to, open said passage port when the temperature of the oil is high, for returning the engine oil to the engine block without routing it to the oil cooler, and close said passage port when the temperature of the oil is low, for routing the engine oil from the engine block to the oil cooler.

2. An engine oil block as claimed in claim 1, wherein:

said oil inlet channel comprises an oil outlet passage which is connectable to the oil inlet of the oil cooler;

said oil outlet channel comprises an oil inlet passage which is connectable to the oil outlet of the oil cooler; and said oil block body is connectable at one side surface thereof to the engine block and at another side surface thereof to the oil filter.

3. An engine oil block as claimed in claim 1, wherein:

said oil block body is formed with a first threaded hole connected at a right angle to said oil inlet channel and a second threaded hole connected at a right angle to said oil outlet channel, wherein said first and second threaded holes are respectively connectable to a thermometer and a pressure gauge to detect the temperature and pressure of the engine oil.

4. An engine oil block for use with an engine block having an oil inlet and an oil outlet, an oil cooler having an oil inlet and an oil outlet, and an oil filter having an oil inlet and an oil outlet, and for use in selectively routing engine oil from the engine block to the oil cooler, said engine oil block comprising:

an oil block body having formed therein, an oil inlet channel connectable at one side thereof to the oil outlet of the engine block and at another side thereof to the oil inlet of the oil cooler, an oil outlet channel connectable at one side thereof to the oil outlet of the oil cooler and at another side thereof to the oil inlet of the oil filter, an oil circulation passage connectable at one side thereof to the oil outlet of the oil filter and at another side thereof to the oil inlet of the engine block, a communication passage connecting said oil inlet channel to said oil outlet channel, and comprising a threaded mounting hole in an end wall thereof and an insert hole in another end wall thereof, a passage port located between said oil inlet channel and said communication passage;

a thermostat provided in said communication passage comprising, a threaded plug screwed into said threaded mounting hole, a seat member fixed to said threaded plug, a shaft secured at one end thereof to said seat member and inserted into said insert hole at another end thereof, a valve member movable along said shaft for opening and closing said passage port, a shape memory alloy member expandable depending on the temperature of the oil, wound spirally along said shaft and arranged between said valve member and said seat member for moving said valve member along said shaft, a bias spring seat retained on said shaft, a bias spring arranged on said shaft between said valve member and said bias spring seat;

wherein said valve member is movable by said shape memory alloy member to, open said passage port when the temperature of the oil is high, for returning the engine oil to the engine block without routing it to the oil cooler, and close said passage port when the temperature of the oil is low, for routing the engine oil from the engine block to the oil cooler.

5. An engine oil block as claimed in claim 4, wherein:

said oil inlet channel comprises an oil outlet passage which is connectable to the oil inlet of the oil cooler;

said oil outlet channel comprises an oil inlet passage which is connectable to the oil outlet of the oil cooler; and said oil block body is connectable at one side surface thereof to the engine block and at another side surface thereof to the oil filter.

6. An engine oil block as claimed in claim 4, wherein:

said oil block body is formed with a first threaded hole connected at a right angle to said oil inlet channel and a second threaded hole connected at a right angle to said oil outlet channel, wherein said first and second threaded holes are respectively connectable to a thermometer and a pressure gauge to detect the temperature and pressure of the engine oil.

7. An engine oil block for use with an engine block having an oil inlet and an oil outlet, an oil cooler having an oil inlet and an oil outlet, and an oil filter having an oil inlet and an oil outlet, and for use in selectively routing engine oil from the engine block to the oil cooler, said engine oil block comprising:

an oil block body having formed therein, an oil inlet channel connectable at one side thereof to the oil outlet of the engine block and at another side thereof to the oil inlet of the oil cooler, an oil outlet channel connectable at one side thereof to the oil outlet of the oil cooler and at another side thereof to the oil inlet of the oil filter, an oil circulation passage connectable at one side thereof to the oil outlet of the oil filter and at another side thereof to the oil inlet of the engine block, a communication passage connecting said oil inlet channel to said oil outlet channel, a passage port located between said oil inlet channel and said communication passage;

a thermostat provided in said oil block body comprising, a valve member for opening and closing said passage port, a shape memory alloy member expandable depending on the temperature of the oil, in contact with one side of said valve member for moving said valve member, and a bias spring in contact with another side of said valve member for opposing the movement of said valve member caused by said shape memory alloy member;

wherein said valve member is movable by said shape memory alloy member to, open said passage port when the temperature of the oil is high, for returning the engine oil to the engine block without routing it to the oil cooler, and close said passage port when the temperature of the oil is low, for routing the engine oil from the engine block to the oil cooler.

8. An engine oil block as claimed in claim 7, wherein:

said oil inlet channel comprises an oil outlet passage which is connectable to the oil inlet of the oil cooler;

said oil outlet channel comprises an oil inlet passage which is connectable to the oil outlet of the oil cooler; and said oil block body is connectable at one side surface thereof to the engine block and at another side surface thereof to the oil filter.

9. An engine oil block as claimed in claim 7, wherein:

said oil block body is formed with a first threaded hole connected at a right angle to said oil inlet channel and a second threaded hole connected at a right angle to said oil outlet channel, wherein said first and second threaded holes are respectively connectable to a thermometer and a pressure gauge to detect the temperature and pressure of the engine oil.

* * * * *